United States Patent [19]

Vollath

[11] Patent Number: 4,887,483

[45] Date of Patent: Dec. 19, 1989

[54] SPEED SENSITIVE SAFETY LOCK FOR ARRESTING A RUNAWAY CONTROL LEVER

[76] Inventor: Guenter Vollath, 50 Wildey St., Tarrytown, N.Y. 10591

[21] Appl. No.: 63,840

[22] Filed: Jun. 19, 1987

[51] Int. Cl.[4] ..... G05G 1/04

[52] U.S. Cl. ..... 74/526; 74/527

[58] Field of Search ..... 74/526, 473 R, 523, 74/142, 34, 372, 569, 519, 530, 527, 531, 501 D; 308/DIG. 9

[56] References Cited

U.S. PATENT DOCUMENTS

| | | | |
|---|---|---|---|
| 37,577 | 2/1963 | Hathaway | 74/526 X |
| 270,107 | 1/1883 | Parvin | 74/526 |
| 1,427,969 | 9/1922 | Pidgeon | 74/526 |
| 1,458,013 | 6/1923 | Tampier | 74/526 |
| 1,479,108 | 1/1924 | Renken | 74/526 |
| 2,477,589 | 8/1949 | Shane | 74/526 |
| 2,545,279 | 3/1951 | Henderson | 74/526 |
| 3,543,602 | 12/1970 | Riedle | 74/526 |
| 3,951,005 | 4/1976 | Dahlostrom | 74/526 X |
| 4,036,077 | 7/1977 | Akiyama | 74/526 |
| 4,078,449 | 3/1978 | Kelly | 74/526 X |
| 4,380,177 | 4/1983 | Reinecke et al. | 74/526 X |
| 4,429,761 | 2/1984 | Haddock et al. | 74/526 X |
| 4,458,761 | 7/1984 | Van Vreeswyk | 74/526 X |

FOREIGN PATENT DOCUMENTS

| | | | |
|---|---|---|---|
| 630757 | 6/1936 | Fed. Rep. of Germany | 74/526 |
| 731399 | 2/1943 | Fed. Rep. of Germany | 84/526 |
| 1152696 | 2/1958 | France | 74/526 |

*Primary Examiner*—Vinh Luong

*Attorney, Agent, or Firm*—Leighton K. Chong

[57] ABSTRACT

A speed sensitive safety lock is provided for arresting and holding a control member when it is moved above a predetermined speed along a control path in one plane in close proximity to a stationary surface. The safety lock comprises a mounting portion for mounting the safety lock to either the stationary surface of the control member, and an arresting member pivotably supported on the mounting portion having a contact surface on one end for making a glancing contact with a part on the control member or the stationary surface as the control member is moved along the control path, and an arresting portion on another end which is movable so as to arrest the control member from further movement when the glancing contact is made at a speed in excess of a predetermined level. The preferred form of the lock has a single moving part and can be readily retrofitted to existing devices.

2 Claims, 3 Drawing Sheets

FIG. 1
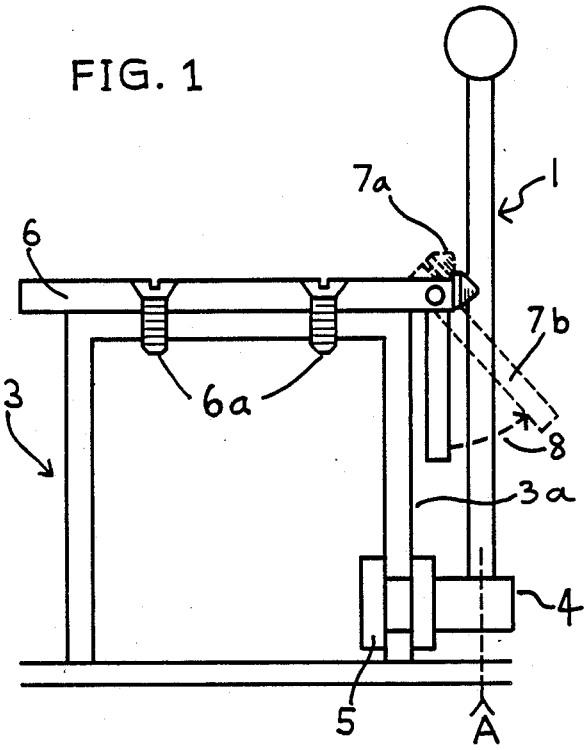
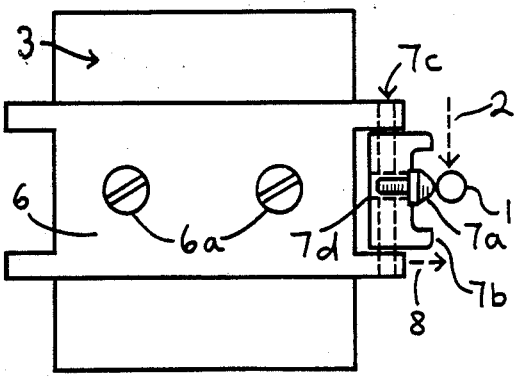
FIG.3A
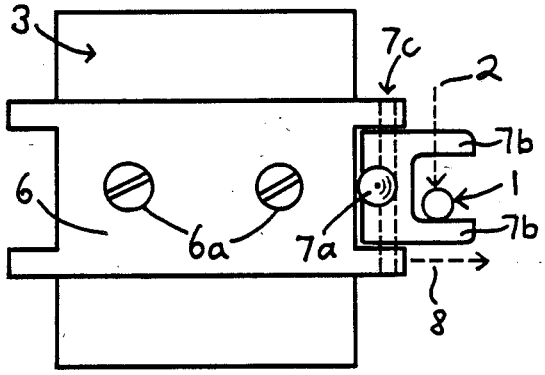
FIG. 3B
FIG.2
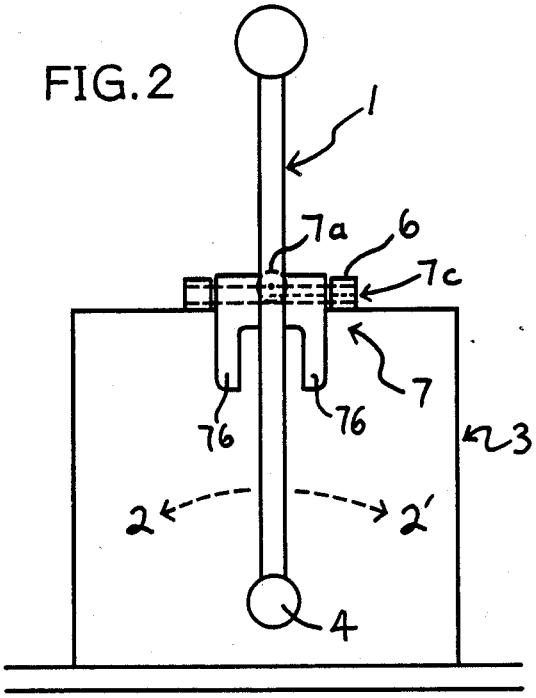
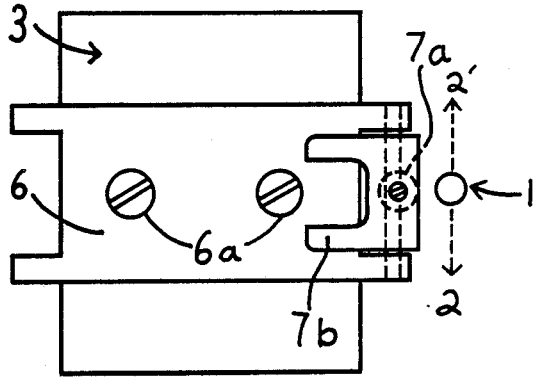
FIG.3C FIG. 9
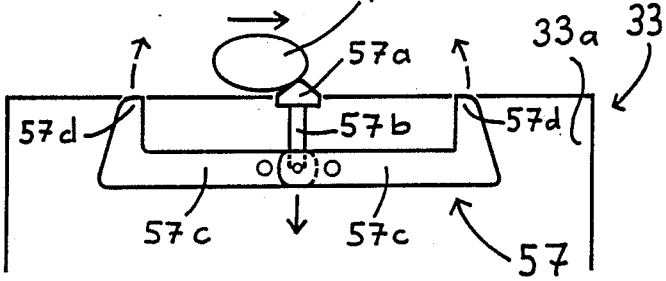
FIG. 11 B
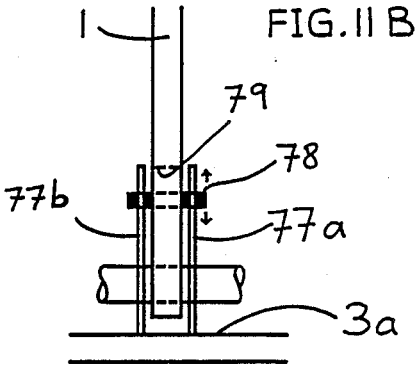
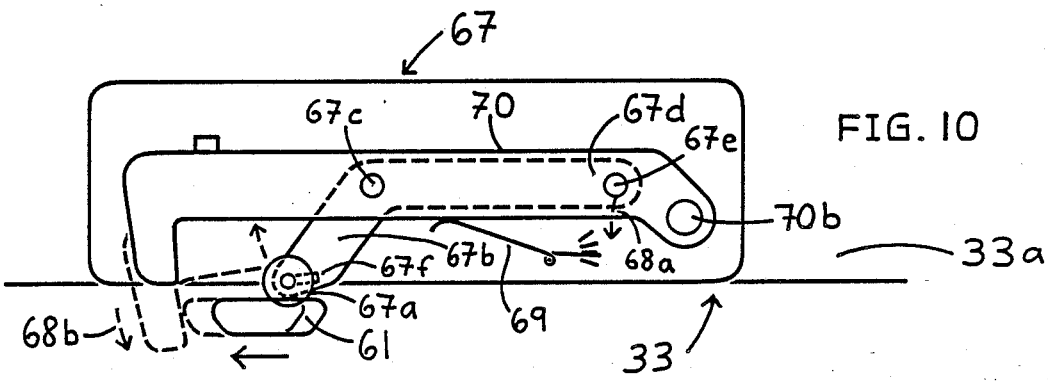
FIG. 10
FIG. 12
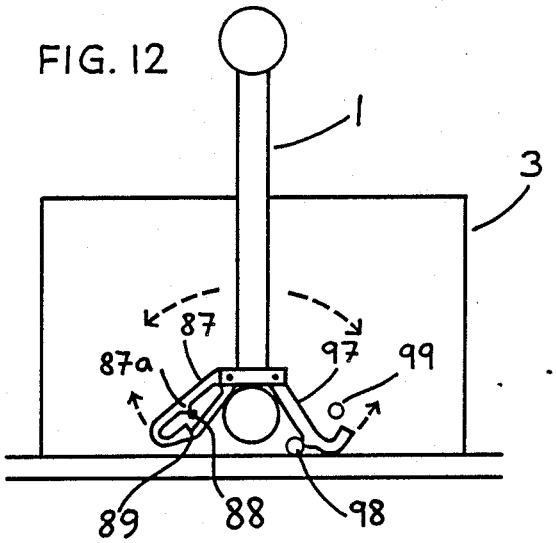
FIG. 11 A
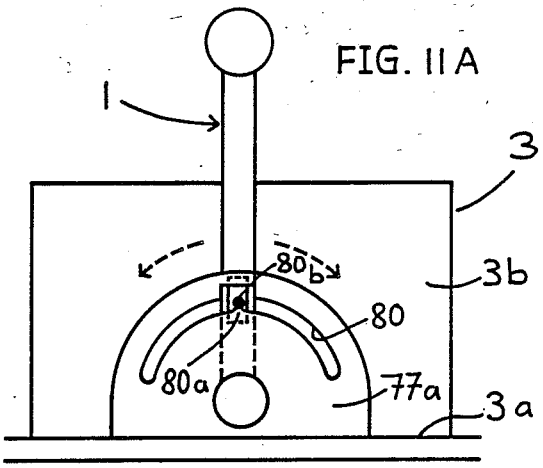
FIG. 13 A
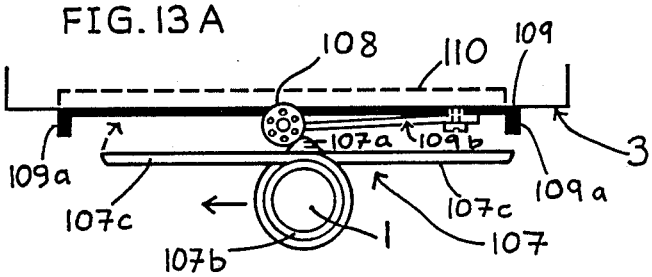
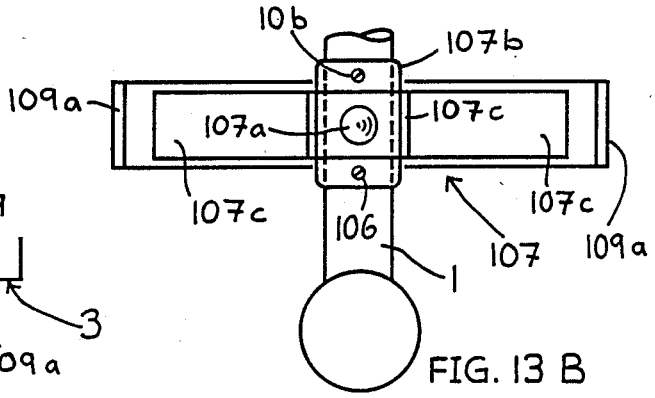
FIG. 13 B

SPEED SENSITIVE SAFETY LOCK FOR ARRESTING A RUNAWAY CONTROL LEVER

FIELD OF THE INVENTION

The invention relates to a speed sensitive safety lock for stopping a moving member when its speed exceeds a predetermined level and, in particular, to a lock having an arresting member which is pivoted to stop the moving member when the moving member collides at an excessive speed with a contact surface on the arresting member.

BACKGROUND OF THE INVENTION

Speed sensitive locking devices are used in many applications, for example, safety brakes for hoist lines, seat belt restraints, and safety catches for doors. Some conventionally known devices employ the action of centrifugal force on a governor or spring-biased triggering member, e.g. on a wheel for hoist lines. Another type of device, such as shown in U.S. Pat. No. 2,979,282 issued on Apr. 11, 1961 to Barecki, uses a pivotable catch lever to arrest a ratchet wheel when its rotational speed is too high. Yet another known device, shown in U.S. Pat. No. 3,504,556 issued on Apr. 7, 1970 to Mills, uses a wavy crested rack and a follower roller on the end of a lever which triggers a locking device.

Conventionally known devices have the disadvantage that they generally require complex mechanisms which are difficult to operate with a high degree of reliability. Many are required to be assembled within the housing of a device, such as an automatic reel or brake, and therefore are not suitable to be retrofitted to existing uses which were not originally provided with a speed sensitive lock. Others known safety locks are employed around a rotating reel or wheel, and cannot be used to arrest a member moving in a linear direction.

The inventor has identified many existing devices and environments which may not have been originally provided with a speed sensitive lock. For example, the throttle levers on boats and other vehicles are generally mounted from the side of a housing and are operated in one or the other direction to accelerate and decelerate an engine. Throwing the lever in one direction too quickly may result in damage to the engine or stripping of the gears. Similarly, brakes and other control levers for machinery which are pulled to a stop position against a spring force may be accidentally dislodged from the stop position and flung to the release position at a high speed.

Accordingly, it is a principal object of the invention to provide a speed sensitive safety lock which has a simple and reliably operated structure, and which can be easily retrofitted to a wide variety of existing devices and operating environments. In particular, it is desired to provide a lock which can be readily mounted onto the side of an existing housing for a moving control lever or other member, or which can be easily installed during the original assembly of a wide variety of devices. It is a further object of the invention to provide a speed sensitive lock which has a small number of moving parts, preferrably only one, and which nevertheless can reliably arrest and hold the moving member.

SUMMARY OF THE INVENTION

In accordance with the above-mentioned purposes of the invention, a speed sensitive safety lock is provided for arresting and holding a control member which is moved along a control path in one plane in close proximity to a stationary surface, comprising a mounting portion for mounting the safety lock to either the stationary surface of the control member, and an arresting member pivotably supported on the mounting portion having a contact surface on one end for making a glancing contact with a part on the control member or the stationary surface as the control member is moved relative to the stationary surface along the control path, and an arresting portion on another end of the arresting member which is movable so as to arrest the control member from further movement when the glancing contact is made with a relative speed in excess of a predetermined level.

In one preferred embodiment of the invention, the arresting member is a single swingable member mounted on a housing having an upper contact surface and a lower pair of spaced apart leg sections. It is pivotably supported on the mounting portion so that the leg sections hang down by gravity parallel to a vertical plane in which a control lever is moved. When the control lever collides with the contact surface moving in either direction at an excessive speed, the lower leg sections of the arresting member are swung sufficiently into the control path to capture it. The contact surface may be a knob on a screw threaded in the upper end of the arresting member, whereby the position of the knob extending into the control path can be adjusted so that the threshold triggering speed can be variably set.

In another version of the invention, the arresting member is pivotably mounted on one side of the control lever facing the housing, and a contact element and a trapping block are mounted on the housing so as to overlap into the plane of movement of the arresting member on the control lever. When the lever is moved at excessive speeds, the contact surface of the arresting member collides with the contact element on the housing with sufficient force to pivot the arresting surface of the arresting member to a position where it is captured in the trapping block in order to jam the lever against further movement. The arresting member may instead be in the form of a hinge which fits around the operating lever and is swingable toward trapping blocks on the housing.

Another embodiment of the speed sensitive safety lock has cooperating actuator and arresting parts mounted to a top side of the housing. When the moving member makes sufficient glancing contact with one end of a spring-biased actuator pin extending perpendicularly into the vertical plane in which the control member moves, the actuator pin is displaced against the end of a pivot lever such that the other end thereof displaces an arresting leg section slidingly into the control path.

Other versions employ a displaceable contact element mounted on the control member and an arresting plate fixed to the housing having a groove in which a contact element slides, a contact surface formed in one part of the groove, and an arresting notch formed opposite the contact surface for capturing the contact element when it is sufficiently displaced by contact at an excessive speed with the contact surface. Alternatively, a contact element is fixed in position on the housing and a displaceable arresting plate with a hooked notch is connected to the control lever. A further version has a contact pin and an arresting pin fixed to the housing, and an arresting hook having a hooked end for hooking onto the arresting pin at excessive speeds.

In accordance with the invention, the speed sensitive safety lock can be easily retrofitted to any existing device, or assembled on an original device, in which a control member moves in a plane in close proximity to a stationary surface, simply by mounting the arresting member to the stationary surface or the control member and adjusting the parts to obtain the locking action at a desired threshold speed. In preferred versions, the arresting member is a single moving part, and the locking action is obtained reliably by the arresting member swinging or pivoting when its contact surface makes sufficient contact with the control member or contact element.

BRIEF DESCRIPTION OF DRAWINGS

The above-mentioned embodiments and the features and advantages of the invention are described in detail below in conjunction with the drawings, of which:

FIG. 1 is a side view of a first embodiment of a speed sensitive safety lock in accordance with the invention in which the arresting member is a single pivotable part mounted to a housing;

FIG. 2 is a front schematic view of the first embodiment shown in FIG. 1;

FIGS. 3A, 3B, and 3C show the arresting member of the first embodiment in different operating positions;

FIG. 9 is a top schematic view of a fifth embodiment of the invention in which the arresting member has a scissors-type pair of legs;

FIG. 10 is a top schematic view of a sixty embodiment of the invention in which the arresting member is a compound pivot lever;

FIGS. 11A and 11B are front and side schematic view of a seventh embodiment of the invention employing an arresting plate and displaceable pin;

FIG. 12 is a front view showing two versions of an eighth embodiment using arresting hooks connected to the control lever; and FIGS. 13A and 13B are top and front schematic views of a ninth embodiment of the invention in which the arresting member is a swingable part sleeved on the control lever.

DETAILED DESCRIPTION OF INVENTION

Figure 4:
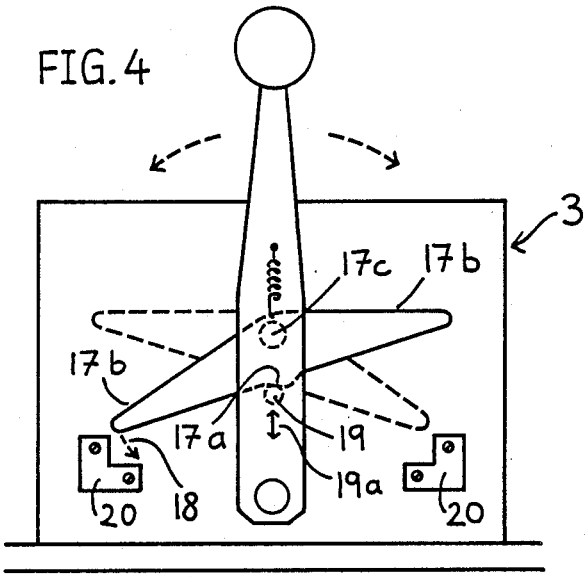
FIG. 4 is a front schematic view of a second embodiment of the invention in which the arresting member is a pivot lever mounted on a control lever

In the following description, several embodiments incorporating the principles of the invention are described. These embodiments have in common that they are intended to be used in any environment where a control member moves along a control path in a plane in close proximity to a stationary surface. The several embodiments indicate the range of devices which may be designed in accordance with the concepts disclosed herein. However, it will be readily apparent that many other variations and mofifications may be used which are within the scope of the invention. Where similar parts are depicted in the different figures of the drawings, the same reference numbers are used.

Referring to FIGS. 1, 2, and 3A–3B, a control member 1 is depicted generally in the form of a control lever which is pivoted in one or the other directions 2 or 2' in a vertical plane A, A stationary surface in the form of a housing 3 has a side 3*a* facing in close proximity to control lever 1. Housing 3 is shown as pivotably supporting the control lever 1 through a pivot shaft 4 and bearings 5. Generally, the mechanism controlled by the control lever, such as a throttle or brake mechanism, is contained in the housing. However, it should be understood that the invention applies in broad principle to any environment where a control member moves in one plane along a control path in close proximity to a stationary surface.

A first embodiment of a speed sensitive safety lock in accordance with the invention has a mounting portion 6 fixed to housing 3 by suitable means, such as screws 6a shown in the figures. The mounting portion is shown fixed to the top of the housing, but may instead be fixed to side 3*a* of the housing. An arresting member 7 is pivotably supported on one end of mounting portion 6 next to the plane of movement A of control lever 1, and has a contact surface in the form of a knob at its upper end, a pair of leg sections 7*b* at its lower end, and a pivot pin 7*c*.

In the initial state of the arresting member 7, as shown in solid lines in FIG. 1, knob 7*a* extends partly into the plane of the control lever, and leg sections 7*b* hang down by gravity parallel to the control lever. When the control lever is moved in one direction at a speed below the trigger level, in FIG. 3A, it makes a glancing contact with knob 7*a* and rides over and past it. Legs 7*b* swing out in the direction of arrow 8 as a result of the glancing contact but, for speeds of the control lever below the threshold, the furthest extent of legs 7*b* is short of the plane of the control lever, or the legs are swung out too slowly to capture the lever. Therefore, the control lever can be moved past arresting member 7 without triggering a locking action.

However, as shown in FIG. 3B, when control lever 1 is moved in the direction of arrow 2 at a speed in excess of a threshold level, it collides with knob 7*a* with sufficient force to knock knob 7*a* far enough backward that legs 7*b* swing out in the direction 8 far and fast enough into plane A to capture the control lever. The latter is held in this arrested state as long it is biased by its weight or any mechanical or tension force on it against the one leg 7*b*. The arresting member 7 is released back to its initial state when the force of control lever 1 against it is released.

Provision is made for adjusting the threshold speed above which the control lever colliding with the contact surface of the arresting member causes the arresting legs to swing out to capture the control lever. Knob 7*a* is shown having a threaded portion 7*d* which threads in a hole in the arresting member so as to adjust the amount by which it projects into the plane of the control lever in the initial state. By adjusting the position of knob 7*a*, the threshold speed at which capture takes place can be adjusted to a desired level. If it is desired to remove the locking action of the arresting member entirely, knob 7*a* can be positioned out of the plane of the control lever, or arresting member 7 can be swung over onto the top side of housing 3, as depicted in FIG. 3C.

In FIG. 4, a second embodiment of the invention is shown mounted on control lever 1 on the side proximate housing 3. Arresting member 17 has contact surface 17*a*, which makes glancing contact with contact element 19 fixedly mounted to the side surface of housing 3, so as to pivot it about pivot point 17*c* by which it is mounted to control lever 1. Contact element 19 is shown by arrows 19*a* as being adjustable in the vertical direction to set the position, and thus, amount of force, with which contact surface 17*a* of arresting member 17 collides with it. With a collision by movement to the left of FIG. 4, arresting member 17 pivots and moves its left end 17*b* downward in the direction of arrow 18. Mounting blocks 20 are fixedly mounted to the side of housing 3 on each side of control lever 1 in positions where, above the threshold speed, arresting end 17*b* is swung downward with sufficient speed to be captured in block 20 to jam control lever 1 against further movement. The positions of blocks 20 may also be adjusted to set the threshold speed for the locking action.

Figure 5A:
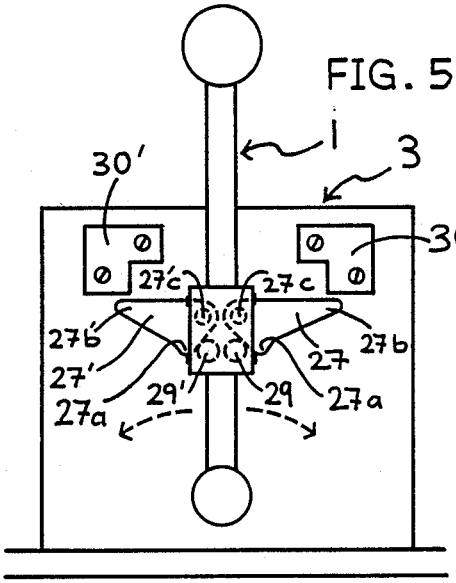
FIGS. 5A and 5B are front and side schematic views of a third embodiment of the invention in which a pair of arresting members are mounted on the control lever.
Figure 5B:
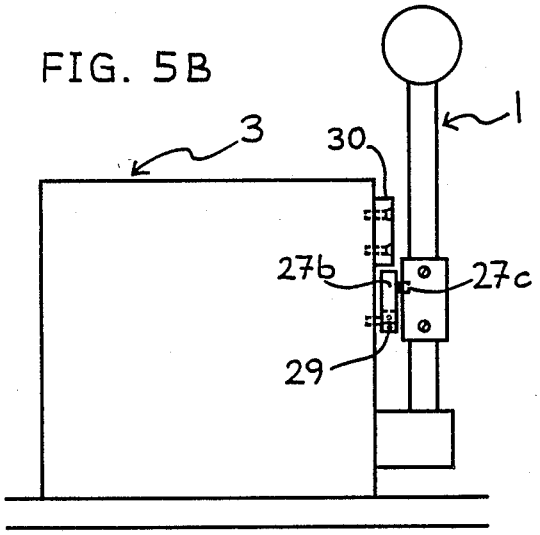
Figure 6:
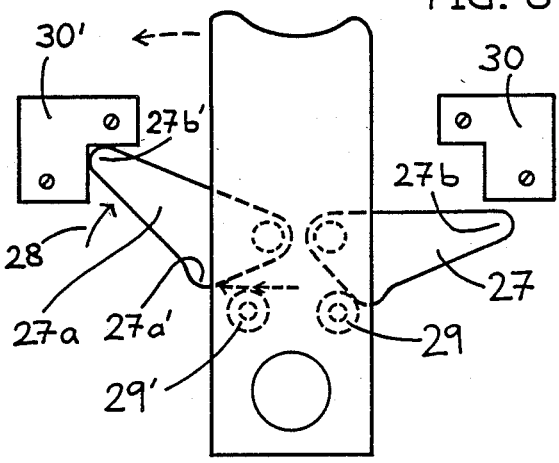
FIG. 6 shows the arresting member of the third embodiment of FIGS. 5A and 5B in the locking position.

In FIGS. 5A and 5B, a third embodiment is shown similar to the one described above. A pair of arresting members 27, 27′ are mounted on pivot points 27*c*, 27*c*′ to the side of control lever 1 which is proximate housing 3, and have respective contact surfaces 27*a*, 27*a*′ which make glancing contact with contact elements 29, 29′ so as to swing arresting ends 27*b*, 27*b*′ into blocks 30, 30′ when control lever 1 is moved in respective directions above the predetermined threshold speed. As shown in FIG. 6, the arresting end 27*b* on the side opposite of the direction of movement of control lever 1 hangs down by gravity clear of the arresting block 30, whereas the arresting end 27*b*′ in the direction of movement is kicked upward (arrow 28) into the capturing block 30′ by the collision of the contact surface 27*a*′ with the contact element 29′ when control lever 1 is moved to the left above the threshold speed, and vice-versa for the opposite direction.

Figure 7:
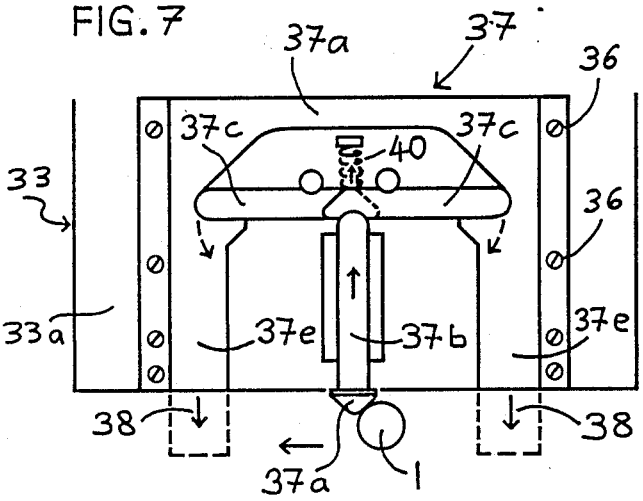
FIG. 7 and FIG. 8 are top schematic view showing two related versions of a fourth embodiment of the invention in which the arresting member has a displaceable actuator pin.

In FIGS. 7–10, four other embodiments of the arresting member are shown which are suitable for convenient mounting to the top side 33*a* of housing 33, such as by screws 36. In FIG. 7, arresting member 37 has contact surface 37*a* which is struck by control lever 1 to displace actuator pin 37*b* against the ends of pivot levers 37*c*. The other ends of pivot levers 37*c* are engaged in notches in arresting plate 37*d* so as to displace the end legs 37*e* on each side of the plate in the direction of arrow 38 into the path of control lever 1. When control lever 1 collides with contact surface 37*a* above the threshold speed, pin 37*b* is displaced with sufficient force to push leg ends 37*e* into the path of the control lever quickly enough to capture it. A light spring 40 bears against the ends of pivot levers 37*c* on the opposite side from pin 37*b* in order to return the pivot levers and the actuator pin to their initial positions when control lever 1 collides with the pin below the threshold speed and is not captured by leg ends 37*e*. Upon capture, the frictional force of the control lever under mechanical or spring tension bearing against leg ends 37*e* holds the control lever in the locked position.

Figure 8:
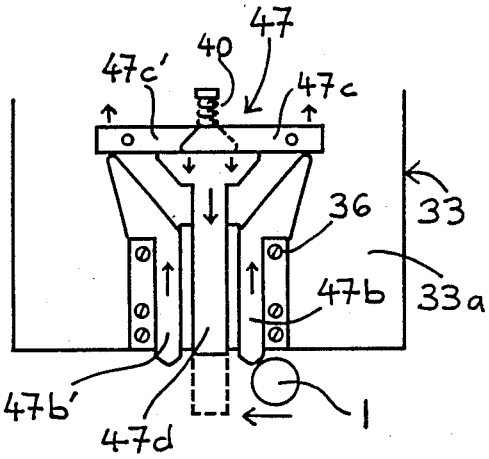

In FIG. 8, arresting member 47 has a pair of actuator pins 47*b*, 47*b*′ on each side which engage respective pivot levers 47*c*, 47*c*′ to move a single arresting leg 47*d* in the middle. As control lever 1 is moved from either side of the arresting member, contact with the pin on the same side above the threshold speed thrusts arresting leg 47*d* into the path of the control lever to hold it from further movement. Another version shown in FIG. 9 has contact surface 57*a*, actuator pin 57*b*, pivot levers 57*c* and arresting ends 57*d* on each side of arresting member 57.

The further version of arresting member 67 shown in FIG. 10 is designed to capture a moving body 61 in only one direction. Arresting member 67 has contact roller 67*a* on the end of a first pivot lever section 67*b* which is pivotable about fixed pivot point 67*c* to move its other end 67*d* in the direction of arrow 68*a*. Pivot point 67*e* is fixed between end 67*d* and a second pivot lever section 70 which is pivotably mounted on fixed pivot point 70*b*. Movement of end 67*d* turns pivot section 70 about pivot point 70*b* to bring its other end 70*c* into the path of moving body 61 when it is moved above a threshold speed (shown by dashed lines). The longitudinal position of contact roller 67*a* from arresting end 70*c* can be adjusted in slot 67*f* of first pivot section 67*b* in order to set the threshold speed at which capture occurs. Leaf spring 69 biases the pivot levers toward their initial state.

In FIGS. 11A and 11B, another embodiment of the invention has a pair of arresting plates 77*a*, 77*b* mounted on each side of control lever 1. Pin 78 is freely displaceable in slot 79 formed in control lever 1. Each arresting plate 77*a*, 77*b* has an arcuate groove 80 with a projection 80*a* formed at a selected capture position on the lower side and an arresting notch 80*b* formed on the upper side. When lever 1 is moved across the capture position above a threshold speed, pin 78 rides in the groove and collides with projection 80*a* with sufficient speed to bump it upwards into arresting notch 80*b*, where it is wedged by the sides of lever slot 79 and notch 80*b*. When the mechanical tension on lever 1 is released, pin 78 is released to fall back into groove 80. Thus, the control lever can be freely moved along its control path below the threshold speed, but will be captured at the capture position if it moves above this speed. A single arresting plate may be used instead of the pair, and it can be mounted to the lower part of the housing as shown, or to the facting side 3*b* if desired.

In FIG. 12, a further embodiment of the invention utilizes an arresting plate 87 or an arresting hook 97 which is mounted to control lever 1. Arresting plate 87 has an inner track the upper side of which bears against pin 88 fixed to housing 3. The arresting member has projection 87*a* at a selected capture position. When the control lever is moved above the threshold speed, the projection collides with pin 88 with sufficient speed to displace the arresting plate upwards so that notch 89 engages pin 88 in a locking action which holds the lever from further movement. When the mechanical tension on the lever is released, arresting plate 87 falls back to its initial state by gravity. Arresting hook 97 works by similar principles with respect to projection 98 and arresting pin 99 fixedly mounted to housing 3.

Another embodiment is shown in FIGS. 13A and 13B wherein an arresting member 107 is provided in the form of a hinge having an sleeve portion 107*b* which slides over control lever 1 and is fixed in position thereon by screws 106. Outer part 107*d* is pivotable on and in bearing contact with sleeve 107*b* and has ends 107*c* extending laterally in each direction. Contact surface 107*a* faces toward the side of housing 3 and engages contact rollerl 108 mounted to housing 3 by plate 109 held in groove 110 formed in the housing. Plate 109 has capturing ends 109*a* spaced apart on each side of the capture position of the arresting member. Contact surface 107*a* is shaped and the capturing ends are spaced from the contact roller at a distance such that, when the lever is moved below the threshold speed, the end of the arresting member is swung toward the housing at a slow speed which does not result in its capture in capturing ends 109*a*. Above the threshold speed, the arresting end becomes jammed in the capturing end 109*a* to lock the control lever. The position of the roller 108 in the path of the contacting surface 107*a* can be adjusted by the adjusting screw 109*b*.

As is apparent from the foregoing description, the invention provides a very simple and reliable safety lock for a locking a moving control member when it is moved above a threshold speed. The speed sensitive safety lock is formed simply by mounting a suitably shaped arresting member to either the stationary surface of a housing or to the control member, and adjusting the contact and arresting positions therebetween so that the control member is arrested or captured when its speed relative to the housing exceeds a triggering level. The lock is particularly suited to be retrofitted on existing control units or conveniently assembled on manufactured devices for use in environments where a threshold speed locking action is desired for safety and other reasons. In some embodiments, the arresting member is formed by a single moving part.

Although several preferred embodiments of the invention has been described above, it should be understood that many variations and modifications are possible within the disclosed principles of this invention. It is intended that the embodiments described herein and all such variations and modifications be included within the scope of the invention, as defined in the following claims.

I claim:

1. A speed sensitive safety lock in combination with a control lever pivotably movable along a control path in a vertical plane parallel to and spaced apart opposite from a stationary member, said safety lock comprising:

a mounting portion which is mounted to said stationary member;

a unitary arresting member pivotably supported on said mounting portion by a pivot pin so as to be swingable under gravity perpendicularly to said vertical plane and including a knob provided on an upper end thereof and positioned to normally project partway into said control path, and an arresting portion formed by a pair of spaced apart leg sections at a lower end thereof extending vertically downward parallel to said vertical plane which is displaceable to an arresting position where it arrests said control member on said control path in response to a glancing contact applied with more than a predetermined threshold force to said knob; and the control lever having a portion which is positioned to make glancing contact with said knob of said arresting member when moved along said control path past said stationary member, wherein said control lever portion strikes said knob with a force greater than said threshold predetermined force when moved at a high speed in excess of a predetermined speed level past said stationary member, thereby causing said leg sections of said arresting portion to be displaced to said arresting position to arrest said control lever.

2. A speed sensitive safety lock according to claim 1, wherein said arresting member includes means for adjusting an amount by which said knob projects into said control path, such that the predetermined speed level of said control lever corresponding to said predetermined threshold force above which said control lever is captured can be adjusted.

* * * * *